US006733342B2

(12) United States Patent
Wu et al.

(10) Patent No.: US 6,733,342 B2
(45) Date of Patent: May 11, 2004

(54) CIGARETTE LIGHTER PLUG THAT CAN BE INSERTED INTO SOCKETS OF DIFFERENT DIMENSIONS

(75) Inventors: Chih-Peng Wu, Taipei (TW); Yi-Chang Lin, Taipei Hsien (TW)

(73) Assignee: Primax Electronics Ltd., Taipei (TW)

( * ) Notice: Subject to any disclaimer, the term of this patent is extended or adjusted under 35 U.S.C. 154(b) by 29 days.

(21) Appl. No.: 09/683,083

(22) Filed: Nov. 15, 2001

(65) Prior Publication Data

US 2002/0177363 A1 Nov. 28, 2002

(30) Foreign Application Priority Data

May 25, 2001 (TW) ..... 90112705 A

(51) Int. Cl.[7] ..... H01R 24/04
(52) U.S. Cl. ..... 439/668
(58) Field of Search ..... 439/668, 669, 439/700, 824, 675, 956, 825, 265, 349, 345

(56) References Cited

U.S. PATENT DOCUMENTS

| | | | | | |
|---|---|---|---|---|---|
| 2,761,111 | A | * | 8/1956 | Klostermann | 439/271 |
| 4,109,193 | A | * | 8/1978 | Schultheis | 320/109 |
| 4,245,881 | A | * | 1/1981 | Michaels | 439/841 |
| 4,655,532 | A | * | 4/1987 | Hillis et al. | 439/607 |
| 5,158,484 | A | | 10/1992 | Chou | |
| 5,261,838 | A | | 11/1993 | Fujie | |
| 5,263,879 | A | | 11/1993 | Sasa | |
| 5,752,847 | A | * | 5/1998 | McCormick | 439/349 |
| 6,004,161 | A | | 12/1999 | Roussy | |
| 6,074,236 | A | | 6/2000 | Wu | |
| 6,116,960 | A | | 9/2000 | Lloyd et al. | |
| 6,312,284 | B1 | | 11/2001 | Tsay | |
| 6,312,289 | B1 | | 11/2001 | Saji | |
| 6,354,882 | B1 | * | 3/2002 | Lindqvist et al. | 439/668 |

FOREIGN PATENT DOCUMENTS

| | | |
|---|---|---|
| TW | 80215042 | 11/1991 |
| TW | 85202171 | 2/1996 |
| TW | 435362 | 3/2000 |

* cited by examiner

*Primary Examiner*—Son Nguyen
(74) *Attorney, Agent, or Firm*—Winston Hsu

(57) ABSTRACT

A cigarette lighter plug includes a front housing and a rear housing, a positive contact end installed at a front end of the front housing for contacting a positive terminal of a cigarette lighter socket, and an elastic element encircling a connecting portion of the front housing and the rear housing for contacting a negative terminal of the cigarette lighter socket. When the elastic element contacts the negative terminal of the cigarette lighter socket, the elastic element is electrically connected with the negative terminal of the cigarette lighter socket.

1 Claim, 4 Drawing Sheets

CIGARETTE LIGHTER PLUG THAT CAN BE INSERTED INTO SOCKETS OF DIFFERENT DIMENSIONS

BACKGROUND OF INVENTION

1. Field of the Invention

The present invention relates to a cigarette lighter plug, and more particularly, to a cigarette lighter plug that can be inserted into sockets of different dimensions.

2. Description of the Prior Art

Today, more and more people are spending greater amounts of time in automobiles, such as to commute back and forth between work. This increasing amount of time spent in automobiles has lead to an increasing amount of electric equipment that is designed for use in cars. This equipment, which may include such items as vacuums, refrigerators, hands-free cellular telephones, battery chargers, and the like, all use a cigarette lighter socket in the car as a power point. With a suitable cigarette lighter plug for the equipment, a user may simply plug the cigarette lighter plug into the cigarette lighter socket to provide power to the electric equipment.

A cigarette lighter socket is designed as a small cylindrical shell with a bottom. The bottom of the cylinder has a positive terminal connected to a positive terminal of the power in the car. The metallic walls of the cylinder connect to the negative terminal of the power in car to form a negative terminal of the cigarette lighter socket. Corresponding plugs for electric equipment are designed to plug into the cigarette lighter socket and draw electrical power from car. To ensure a good electrical connection between the plug and the socket, the plug must fit snugly with the cigarette lighter socket in the car so as to avoid the plug from disconnecting from the socket due to vibration or shaking.

The typical cigarette lighter plug is designed as a small plastic cylinder. A front end of the plug, corresponding to the bottom of the socket, has a metal protrusion for contacting the positive terminal of the bottom of the cigarette lighter socket. On the side surface of the plug is at least one broad-surfaced metal contact to establish an electrical connection with the negative contact surface of the walls of the socket. When the cigarette lighter is plug is plugged into the cigarette lighter socket, the broad-surfaced contact connects with the negative terminal of the walls of the cigarette lighter socket to electrically connect the electric equipment to power. As noted before, an external diameter of the cigarette lighter plug should tightly match the corresponding dimension of the cigarette lighter socket. When this is so, to disengage the plug from the cigarette lighter socket, friction generated by the broad-surfaced contact must be overcome.

Unfortunately, there are at least two different design specifications for cigarette lighter sockets. For Japanese cars, the diameter of a cigarette lighter socket is about 21 mm. On the other hand, for German cars the diameter is slightly larger, at about 22 mm. The difference between the two dimensions is thus about 1 mm. If a cigarette lighter plug with the smaller external diameter is plugged into the larger diameter socket, a loose fit will result, leading to a poor, intermittent electrical connection. Correspondingly, cigarette lighter plugs with the larger external diameter simply cannot be plugged into the smaller dimensioned cigarette lighter sockets. Consequently, manufacturers must design two types of cigarette lighter plugs to account for the two different external diameters of sockets. This is a nuisance for the manufacturers of electric equipment for cars.

U.S. Pat. No. 6,116,960 provides a cover for cigarette lighter plugs having a small external diameter to solve this problem so that they may be used in larger dimensioned cigarette lighter sockets. However, adding a cover not only increases the costs associated with manufacturing and packing, but the cover can also be easily lost.

SUMMARY OF INVENTION

It is therefore a primary objective of the present invention to provide a cigarette lighter plug which can be inserted in sockets of different dimensions to solve the above-mentioned problem.

According to claimed invention, a cigarette lighter plug is provided that can be inserted into cigarette lighter sockets of different dimensions. The cigarette lighter plug includes a front housing and a rear housing, a positive contact end installed at a front end of the front housing for contacting a positive terminal of a cigarette lighter socket, and an elastic element encircling a connecting portion of the front housing and the rear housing for contacting a negative terminal of the cigarette lighter socket. When the elastic element contacts the negative terminal of the cigarette lighter socket, the elastic element is electrically connected with the negative terminal of the cigarette lighter socket.

It is an advantage of the present invention that the present invention cigarette lighter plug does not require a cover as an adapter to plug into cigarette lighter sockets of different dimensions.

These and other objectives and advantages of the present invention will no doubt become obvious to those of ordinary skill in the art after having read the following detailed description of the preferred embodiment that is illustrated in the various figures and drawings.

DETAILED DESCRIPTION

Figure 1:
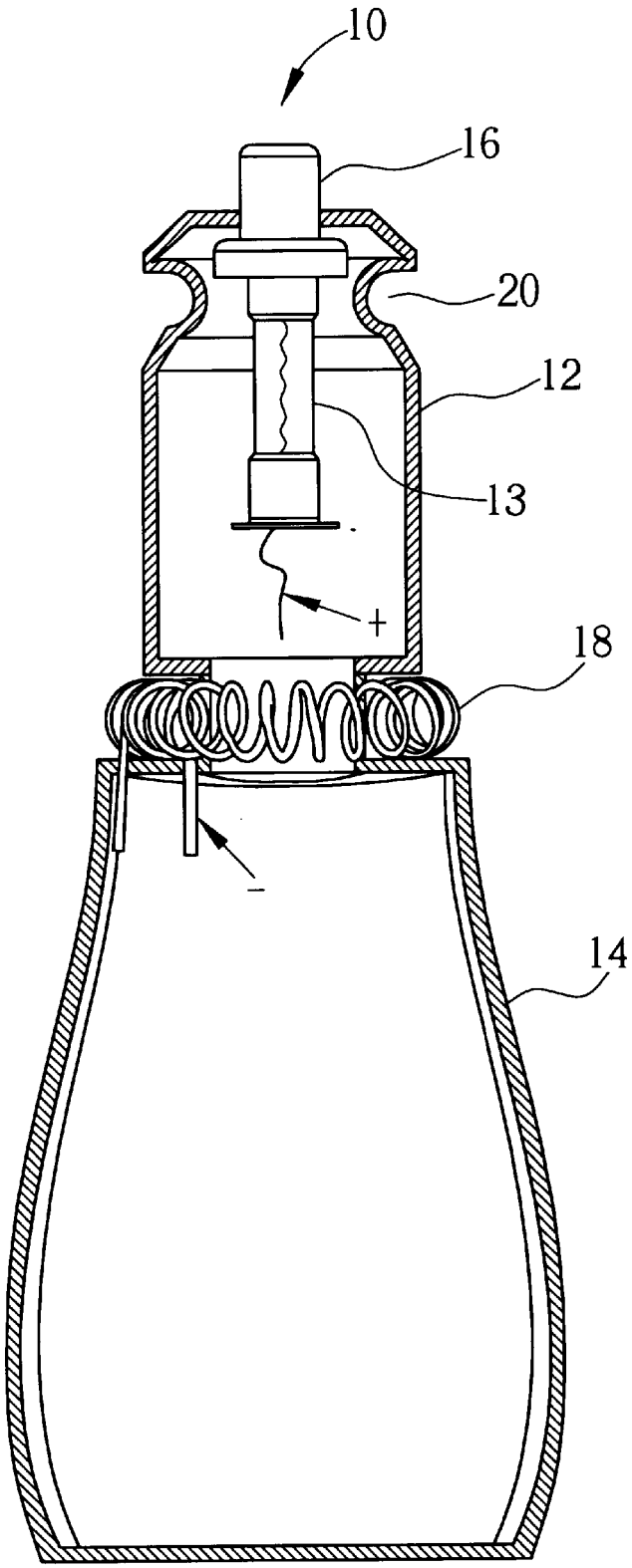
FIG. 1 is a diagram of a present invention cigarette lighter plug.

Please refer to FIG. 1. FIG. 1 is a diagram of a present invention cigarette lighter plug 10. The cigarette lighter plug 10 comprises a front housing 12, a rear housing 14, a positive contact end 16 installed at a front end of the front housing 12 and electrically connected to a fuse 13, and a spiral element 18 encircling a connecting portion of the front housing 12 with the rear housing 14. The spiral element 18 serves as a negative terminal for the cigarette lighter plug 10. The front end of the front housing 12 has a ringed groove 20 that serves as a mechanical connecting and securing device for the cigarette lighter plug 10.

Figure 2:
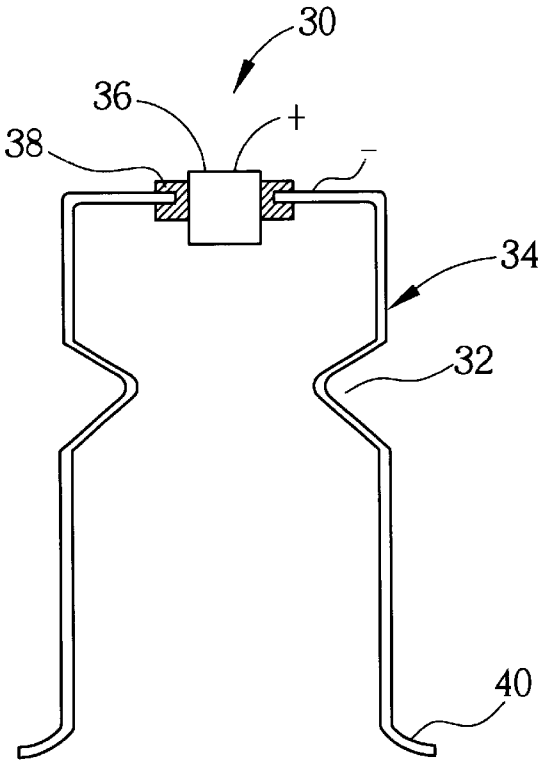
FIG. 2 is a diagram of a cigarette lighter socket.

Please refer to FIG. 2. FIG. 2 is a diagram of a cigarette lighter socket 30 as found in a typical automobile. The cigarette lighter socket 30 comprises a housing 34, with a diameter of 21 mm or 22 mm, electrically connected to a negative terminal of the automobile power source, a positive contact end 36 electrically connected to a positive terminal of the automobile, and an insulator 38 for isolating the negative terminal from the positive terminal of the cigarette lighter socket 30. The housing 34 has a ringed protrusion 32 at a position corresponding to the ringed groove 20 of the cigarette lighter plug 10, and is used to mechanically grip the ringed groove 20 of the cigarette lighter plug 10. Furthermore, the housing 34 has a flared edge 40 at a position corresponding to the spiral element 18 of the cigarette lighter plug 10.

Figure 3:
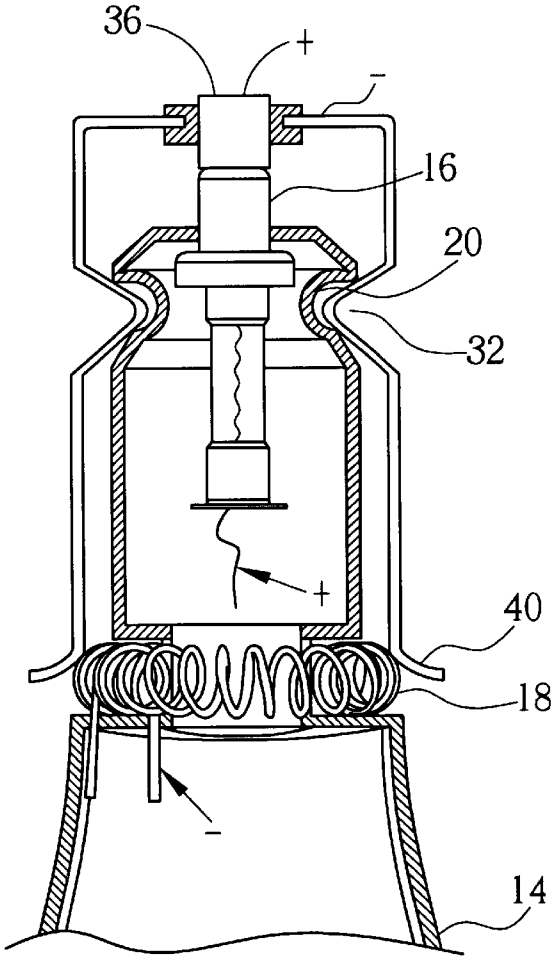
FIG. 3 is a diagram of the cigarette lighter plug in FIG. 1 plugging into the cigarette lighter socket of FIG. 2.

Please refer to FIG. 3. FIG. 3 is a diagram of the cigarette lighter plug 10 plugged into the cigarette lighter socket 30. When the cigarette lighter plug 10 plugs into the cigarette lighter socket 30, the ringed groove 20 of the cigarette lighter plug 10 mechanically locks with the ringed protrusion 32 of the cigarette lighter socket 30. In this way, even if the car shakes or vibrates, the cigarette lighter plug 10 will not disengage from the cigarette lighter socket 30. The positive contact end 16 of the cigarette lighter plug 10 is in contact with the positive contact end 36 of the cigarette lighter socket 30 to form a positive electrical connection, and the spiral element 18 of the cigarette lighter plug 10 is in contact with the protruding edge 40 of the cigarette lighter socket 30 to form a negative electrical connection.

Figure 5:
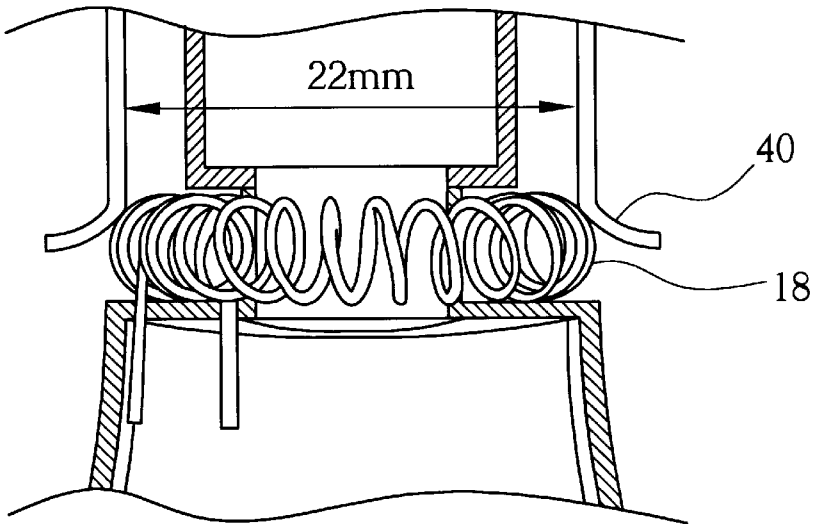
FIG. 4 and FIG. 5 are diagrams of a spiral element of the cigarette lighter plug of FIG. 1 contacting with a protruding edge of the cigarette lighter socket of FIG. 2.
Figure 4:
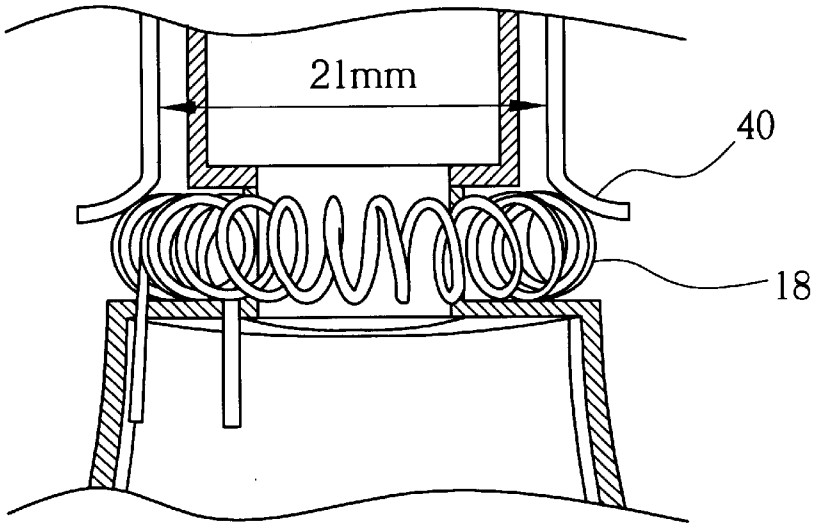

Please refer to FIG. 4 and FIG. 5. FIG. 4 and FIG. 5 are diagrams of the spiral element 18 in contact with the flared edge 40. FIG. 4 is an example of the cigarette lighter socket 30 with a diameter of 21 mm. FIG. 5 is an example of the cigarette lighter socket 30 with a diameter of 22 mm. As the spiral element 18 is an elastic element, regardless of whether the dimensions of the cigarette lighter socket 30 correspond to a diameter of 21 mm or 22 mm, the spiral element 18 and the protruding edge 40 remain in contact with each other.

Figure 6:
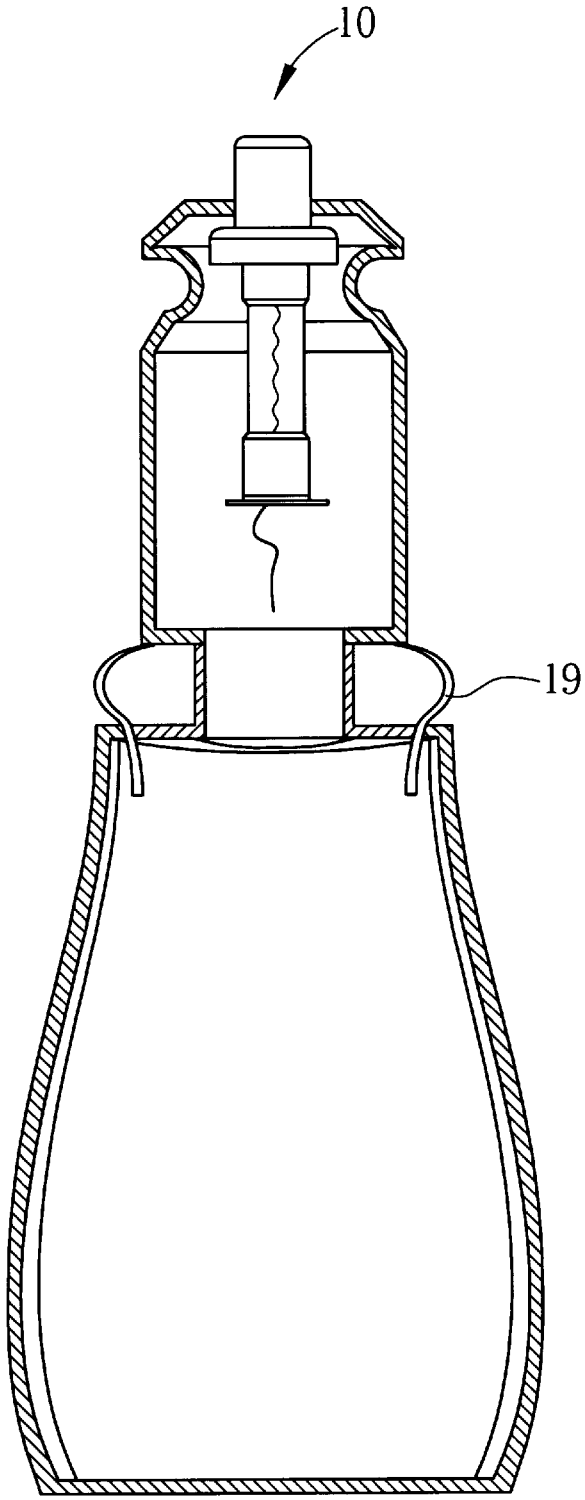
FIG. 6 is a diagram of another embodiment of the present invention cigarette lighter plug.

The above-mentioned spiral element 18 can be replaced by a ringed metal flange 19 as shown in FIG. 6. FIG. 6 is a preferred embodiment of the cigarette lighter plug 10 using the metal flange 19 as a negative contact element. Since the metal flange 19 is elastic, when the cigarette lighter plug 10 is plugged into the cigarette lighter socket 30, the flaring edge 40 of the cigarette lighter socket 30 will compress the metal flange 19 and electrically connect with the metal flange 19.

In the contrast to the prior art cigarette lighter plug, the present invention cigarette lighter plug 10 comprises a spiral element 18 or a metal flange 19. Regardless of whether the dimensions of the cigarette lighter socket 30 correspond to a 21 mm diameter or a 22 mm diameter, the spiral element 18 or the metal flange 19 is able to make contact with the flaring edge 40 of the cigarette lighter socket 30 to generate an electrical connection. Additionally, when the cigarette lighter plug 10 plugs into the cigarette lighter socket 30, the cigarette lighter plug 10 locks with the cigarette lighter plug 10 by way of interaction between the ringed groove 20 and the ringed protrusion 32. The cigarette lighter plug 10 thus ensures a snug connection with the cigarette lighter socket 30.

Those skilled in the art will readily observe that numerous modifications and alterations of the device may be made while retaining the teachings of the invention.

Accordingly, the above disclosure should be construed as limited only by the metes and bounds of the appended claims.

What is claimed is:

1. A cigarette lighter plug for inserting into a cigarette lighter socket, the cigarette lighter plug comprising:

a front housing and a rear housing;

a positive contact end installed at a front end of the front housing for contacting a positive terminal of the cigarette lighter socket; and an elastic element encircling a connecting portion of the front housing and the rear housing for contacting a negative terminal of the cigarette lighter socket;

wherein the elastic element has a spiral shape.

* * * * *